United States Patent [19]

Smith

[11] 4,149,435

[45] Apr. 17, 1979

[54] KEY SLUG KNOCKOUT TOOL

[76] Inventor: Gordon E. Smith, 641 S. Main St., Red Lion, Pa. 17356

[21] Appl. No.: 860,130

[22] Filed: Dec. 13, 1977

[51] Int. Cl.[2] ..... B25B 7/02

[52] U.S. Cl. ..... 81/426; 81/5.1 R

[58] Field of Search ..... 81/418, 420, 425 R, 81/425 A, 426, 5.1 R

[56] References Cited

U.S. PATENT DOCUMENTS

| | | | |
|---|---|---|---|
| 950,849 | 3/1910 | Hammond | 81/5.1 R |
| 2,700,910 | 2/1955 | Van Niel | 81/426 |

*Primary Examiner*—James L. Jones, Jr.

*Attorney, Agent, or Firm*—C. Hercus Just

[57] ABSTRACT

A manually operable tool to knock out identification slugs from the heads of keys such as ignition and door keys for automotive vehicles while the keys are mounted upon a key ring passing through holes in said slugs, the tool comprising a pair of jaws on handles pivotally connected adjacent the jaws, one jaw having a seat to position the end portion of the head of a key which is beyond the slug and the other jaw having a pair of spaced lugs positioned to straddle the key ring and engage the opposite portions of the slug which are on opposite sides of the hole in said slug to punch said slug from said head of the key when said jaws are moved toward each other.

2 Claims, 4 Drawing Figures

KEY SLUG KNOCKOUT TOOL

BACKGROUND OF THE INVENTION

This invention pertains to a tool adapted to punch or knock out slugs formed in the head of keys, especially keys of the type controlling the ignition, doors and the like, of automotive vehicles, although the invention is not restricted to keys for such purposes. The slugs of the type referred to are those which contain code numbers listed by the manufacturer of certain articles with which said keys are sold in order that replacement keys might be ordered by the code number if the keys are lost. Therefore, it is preferred that the slugs bearing these code numbers be removed from the keys and retained by the owner of the article for safekeeping for eventual possible use. In accordance with the invention, a tool has been devised which is capable of readily removing such slugs from the heads of keys by special configurations on a pair of cooperating jaws connected to handles which are pivotally connected, the tool in general somewhat resembling conventional pliers.

Many types of specialty tools have been devised for special purposes, a great number of such tools being in the nature of a pair of pliers but special configurations and devices being provided in the jaws of the tools for accomplishing special operations and functions. For example, in the optical industry, opticians utilize a very substantial number of special types of plier-like tools for purposes of adjusting certain features and elements of eyeglass frames. Another field in which special tools of the pivoted handle type are employed is that in regard to clinching the links and hooks of anti-skid tire chains. Many other fields and arts also employ special tools of this general type and, by way of example, the following patents are illustrative and representative of special tools of the type to which reference is made above:

U.S. Pat Nos. 1,198,231, Houchin, 1916; 1,409,835, Doble, 1922; 2,625,067, Stone et al, 1953; 2,811,065, Johnson, 1957.

SUMMARY OF THE INVENTION

It is one of the principal objects of the present invention to provide a tool adapted to knock out the identifying slugs in the heads of keys. It is common practice at present in the automotive industry to furnish a purchaser of an automotive vehicle with at least a pair of so-called ignition and/or door keys which have the aforementioned identifying slugs formed therein, and said keys are conventionally mounted on a small key ring to which a tag or other additional identifying means is attached to the same key ring. As far as is known, at present, there is not tool available for punching or knocking out said identifying slugs from the heads of keys while the keys are held upon a key ring either with or without a further identifying tag. Said slugs, incidentally, usually have a hole in the central portion thereof through which the key ring extends and it is current practice to remove the keys from the key ring and individually punch the slug by any available means, most of which operate awkwardly, and then return the key to the key ring, minus the slug or, if desired, the punched-out slug also may be mounted upon the key ring for eventual disposition by the purchaser of the automotive vehicle to which said keys pertain. The present invention comprises an improved means by which said identifying slugs may be punched or knocked out of the heads of keys while both the slugs and the keys are mounted upon a key ring and the main object of the present invention is to provide jaws which include seating means for the outer end of the head of the key in which the removable slug is located in spaced relation to the outer end of said head and said seating means being clear of the slug, and additional means are provided on one of the jaws for movement toward and from the first-mentioned jaw, said additional means comprising a pair of transversely-spaced lugs which extend beyond the seating means on the first-mentioned jaw, and are adapted to engage portions of the slug respectively on opposite sides of the hole therein through which the key ring extends and said key ring being accommodated in the space between said lugs, whereby the slug may be punched from the head of the key while the key and the slug are still mounted upon the key ring and thereby require no removal of the keys initially from the key ring.

Another object of the invention is to provide in said seating means a supporting surface having a length no greater than the outer portion of the head of the key between the slug therein and the terminal end of the key head, said seating means also including a surface which is perpendicular to the supporting surface and serves as a stop by which the end of the key head is accurately located upon the seating means in order to position and slug in the key accurately with respect to the lugs on the other jaw of the tool which function to punch the slug from the head of the key.

A still further object of the invention is to mount said jaws respectively upon similar ends of a pair of pivotally connected handle members somewhat resembling a pair of pliers and said jaws being mounted upon said handles in a manner to provide adequate space therebetween to accommodate the key ring incident to the slug being punched from the head of the key.

Details of the foregoing objects and of the invention, as well as other objects thereof, are set forth in the following specification and illustrated in the accompanying drawing comprising a part thereof.

DETAILED DESCRIPTION OF THE INVENTION

Figure 1:
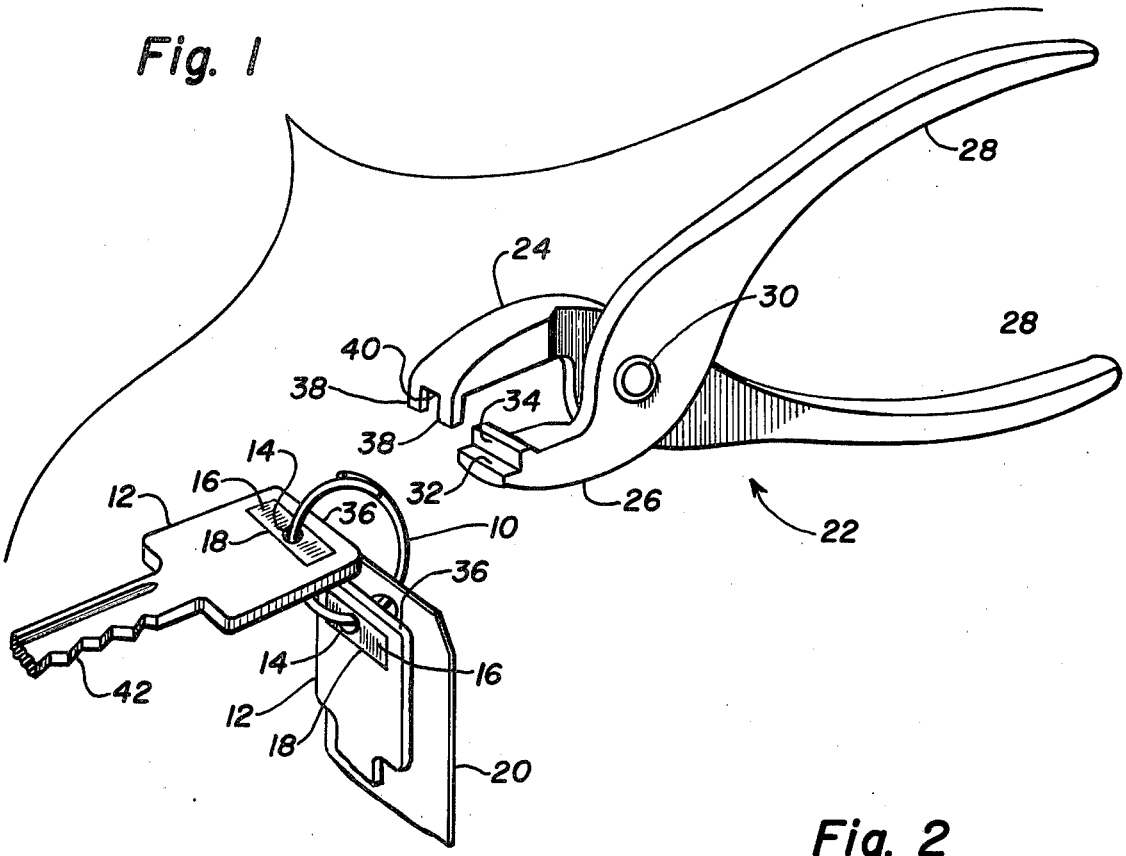
FIG. 1 is an exploded perspective view illustrating a typical arrangement of a plurality of keys on a key ring, and a tool embodying the principles of the present invention in position for the jaws thereof to engage one of the keys for purposes of knocking the identifying slug from the head thereof.

Referring to FIG. 1 of the drawing, there is illustrated therein a conventional type of key ring 10 commonly employed by automotive companies for purposes of connecting the ignition or door keys 12 together by extending the key ring 10 through holes 14 formed in removable identifying slugs 16, which normally fit tightly within complementary recesses 18 formed in the heads of the keys 12. It is also quite customary to mount additional means such as tag 18 on the key ring 10, in addition to the keys 12, said tags normally having certain data thereon pertaining to the automotive vehicle with which the keys are employed. As referred to hereinabove, it is normal for purposes of removing the slug 16 from the heads of the keys 12, to remove the same from the key ring 10 and individually knock the slugs 16 from the heads of the keys by any conceivable means, which frequently operate awkwardly, and then returning the keys through the key ring with or without the slugs 16 also being mounted on the key ring.

The principal purpose of the present invention is to provide an appropriate knockout tool 22, which comprises a pair of jaws 24 and 26 which are connected to, and preferably are integral with the outer ends of a pair of handles 28 which are pivotally connected by a suitable pintle 30 and somewhat resemble a pair of pliers.

Figure 2:
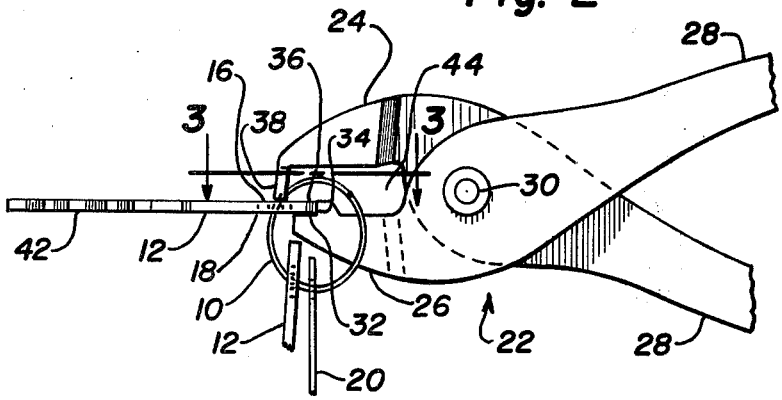
FIG. 2 is a fragmentary side elevation showing one of the keys in position between the jaws of the tool at the initiation of the slug removal operation.
Figure 3:
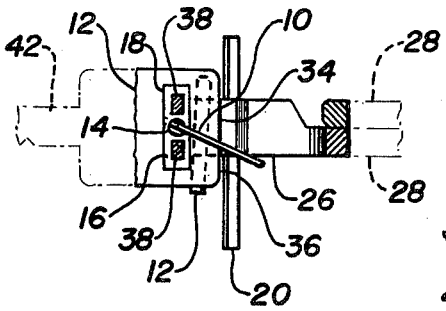
FIG. 3 is a fragmentary sectional view taken on the line 3—3 of FIG. 2.
Figure 4:
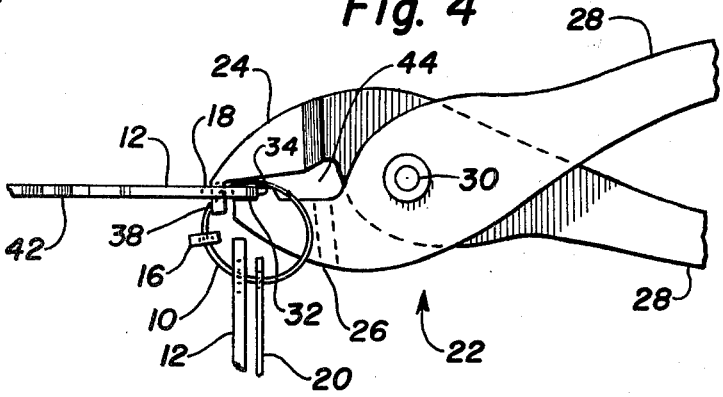
FIG. 4 is a fragmentary view similar to FIG. 2 but showing the tool in the position it occupies following the removal of a slug from the head of the key and said slug being shown in spaced relation to the key head but still mounted upon the key ring.

One of the jaws, such as jaw 26, is provided with seating means comprising a plurality of angularly related surfaces 32 and 34, the surface 32 being a supporting surface for the outermost terminal end portion 36 of the head of each key 12, while the surface 34, which is perpendicular with respect to surface 32, is abutted by the terminal surface of the outermost end portion 36 of the key head 12 in order to position the slug 16 suitably for being removed from the head of the key without being interfered with by the jaw 26, as can be seen from FIGS. 2–4. Accordingly, the length of the surface 32 in a direction linearly of the handle 28 to which it is connected, is less than the width of the outermost terminal end portion 36 of the head of the key in the direction of the axis of the key.

The jaw 24 is provided with knockout means comprising a pair of transversely spaced lugs 38 which are parallel to abutment surface 34 and have a notch 40 therebetween, the lugs 38 extending beyond the outer ends of the jaw 26, especially the surface 32 thereon, as can also readily be seen from FIGS. 2–4. As is evident from FIG. 3, the lugs 38, which are shown in cross-section therein, are positioned so as to be on opposite sides of the hole 14 in the slug 16, whereby when the key ring 10 is positioned substantially as illustrated in FIG. 3, with respect to jaw 26, the handles 28 of the tool may be moved toward each other while the key 12 is grasped along the shank 42 of the key 12 which is having the slug punched therefrom so as to extend substantially axially with respect to the longitudinal axis of the tool 22, whereupon continued movement of the handles 28 toward each other will result in the lugs 38 being projected against the slug 18, and thereby knock the same from the recess 18, as readily seen in FIG. 4, such removal being accomplished while the keys 12, slugs 16, and any other additional elements, such as tag 20, remain mounted upon the key ring 10, thereby saving the nuisance of having to first remove the keys from the key ring 10 in order to punch the slug 16 from the heads of the keys.

It also will be seen from FIG. 2 that there is sufficient space 44 between the opposing substantially parallel faces of the jaws 24 and 26 to readily accommodate the key ring 10, as can fully be appreciated from FIG. 2.

It also will be seen from FIGS. 2 and 4, in particular, that the height of the surface 34, which is perpendicular to the supporting surface 32 on jaw 26, preferably is substantially the same height as the thickness of the head of the key 12, particularly that when the jaw 24 and lugs 38 have been projected to the knockout position as viewed in FIG. 4, the projection upon which the surface 34 occurs, will not interfere with the key ring 10 when disposed within the space 34 between the relatively closed jaws 24 and 26.

From the foregoing, it will be seen that the present invention provides a very simple type tool that is highly efficient and effective to remove the identifying slugs 16 from the heads of the keys 12 without removing either of the same from the key ring 10, thereby not only providing a convenient means by which the slugs may be knocked from the heads, but, in addition, providing considerable saving in time to accomplish the operation.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A manually operable tool to knock out identification slugs from the head of a key having a hole through the slug to receive a key ring, said tool being constructed to punch the slug from the head while the key ring extends through said hole and comprising in combination, a pair of cooperating jaws of substantially the same width, means supporting said jaws for movement toward and from each other to punch the slug from the key head as aforesaid, one of said jaws having one end formed with a seat comprising angularly related surfaces including an abutment surface comprising a positioning stop respectively to receive and position the outer end portion of the key head which is outward from said slug and the other jaw extending a short distance beyond said seat of said one jaw and having a transversely-spaced pair of lugs with parallel side walls and substantially twice as long as the depth of said seat and said lugs being substantially parallel to said abutment surface of said seat and said lugs being positioned to engage opposed portions of said slug in said key head on opposite sides of said hole in said slug and said lugs being arranged to straddle the key ring in said slug which is received between the opposed parallel walls of said space between said lugs, whereby said lugs are operable to punch the slug from said key head when said jaws are moved toward each other while the key remains upon the key ring.

2. The tool according to claim 1 in which the surface of the seat on said on jaw which comprises a positioning stop is on a wall of said seat which has a height above the supporting surface of said seat substantially equal to the thickness of the head of a key and the other jaw having a surface extending rearwardly from said lugs which is spaced from said seat in said one jaw at the initiation of the punching operation upon the slug in the head of a key when positioned upon said seat and thereby providing space to accommodate a key ring passing through the hole in said slug.

* * * * *